US009274539B2

(12) United States Patent
Ok

(10) Patent No.: US 9,274,539 B2
(45) Date of Patent: Mar. 1, 2016

(54) VOLTAGE TRIMMING CIRCUIT AND METHOD OF SEMICONDUCTOR APPARATUS

(71) Applicant: SK hynix Inc., Icheon-si, Gyeonggi-do (KR)

(72) Inventor: Seung Han Ok, Icheon-si (KR)

(73) Assignee: SK Hynix Inc., Gyeonggi-do (KR)

( * ) Notice: Subject to any disclaimer, the term of this patent is extended or adjusted under 35 U.S.C. 154(b) by 229 days.

(21) Appl. No.: 13/720,578

(22) Filed: Dec. 19, 2012

(65) Prior Publication Data

US 2014/0062452 A1 Mar. 6, 2014

(30) Foreign Application Priority Data

Aug. 30, 2012 (KR) ..... 10-2012-0095551

(51) Int. Cl.
*G05F 3/16* (2006.01)
*G05F 3/24* (2006.01)

(52) U.S. Cl.
CPC ... *G05F 3/16* (2013.01); *G05F 3/24* (2013.01)

(58) Field of Classification Search
None
See application file for complete search history.

(56) References Cited

U.S. PATENT DOCUMENTS

| | | | | |
|---|---|---|---|---|
| 8,791,683 | B1 * | 7/2014 | Porter et al. | 323/313 |
| 2006/0279442 | A1 * | 12/2006 | Kimura et al. | 341/121 |
| 2009/0201067 | A1 * | 8/2009 | Haneda | 327/306 |
| 2011/0050286 | A1 * | 3/2011 | Son | 327/72 |

FOREIGN PATENT DOCUMENTS

KR 100541824 B1 1/2006

* cited by examiner

*Primary Examiner* — Timothy J Dole
*Assistant Examiner* — Monica Mata
(74) *Attorney, Agent, or Firm* — William Park & Associates Ltd.

(57) ABSTRACT

A voltage trimming circuit of a semiconductor apparatus includes: a first voltage trimming unit configured to trim a first reference voltage having a first characteristic with respect to temperature based on a first trimming signal, and generate a first trimming reference voltage; a second voltage trimming unit configured to trim a second reference voltage having a second characteristic with respect to the temperature based on a second trimming signal, and generate a second trimming reference voltage; and an adjusting unit configured to trim a voltage formed from a potential difference between the first and second trimming reference voltages based on a select signal, and generate a final trimming reference voltage.

13 Claims, 6 Drawing Sheets

VOLTAGE TRIMMING CIRCUIT AND METHOD OF SEMICONDUCTOR APPARATUS

CROSS-REFERENCES TO RELATED APPLICATION

The present application claims priority under 35 U.S.C. §119(a) to Korean application number 10-2012-0095551 filed on Aug. 30, 2012 in the Korean Intellectual Property Office, which is incorporated herein by reference in its entirety.

BACKGROUND

1. Technical Field

The present invention generally relates to a semiconductor apparatus, and more particularly, to a voltage trimming circuit and method of a semiconductor apparatus.

2. Related Art

A semiconductor apparatus requires various internal voltages VPP, VBB, VCORE, and VBLP depending on the purpose. In general, the semiconductor apparatus generates a reference voltage and then generates an internal voltage from the generated reference voltage. In order to generate a stable internal voltage, the reference voltage must be stably provided at a target level.

However, the reference voltage may have a minute difference from the target level, due to design in which the semiconductor fabrication process environment or process margin is not considered. Therefore, an operation of trimming the reference voltage level is required to adjust the voltage to the target level.

FIG. 1 is a circuit diagram illustrating a voltage trimming circuit 1 used in a conventional semiconductor apparatus.

The trimming circuit 1 includes a reference voltage provider 10, a divided voltage generator 20, and a trimming reference voltage selector 30.

The reference voltage provider 10 may be configured to generate a predetermined reference voltage VREF from an external voltage VDD.

For example, the reference voltage provider 10 includes a constant current source I and a first NMOS transistor N1. The constant current source I is connected to the external voltage VDD and configured to supply a constant current. The first NMOS transistor N1 having a diode-type structure is connected in series between the constant current I and a ground voltage VSS. A voltage applied to the first NMOS transistor N1 by the current supplied from the constant current source I is outputted as the reference voltage VREF.

The divided voltage generator 20 may be configured to generate a plurality of divided voltages Vtrim<0:7> having various voltage levels based on the reference voltage VREF.

For example, the divided voltage generator 20 includes first to third PMOS transistors P1 to P3, second to sixth NMOS transistors N2 to N6, and first to eighth resistors R1 to R8.

The first and second PMOS transistors P1 and P2 and the second and third NMOS transistors N1 and N2 form a current mirror structure. The second NMOS transistor N2 receives the reference voltage VREF through a gate terminal thereof. The fourth NMOS transistor N4 receives a bias voltage VBIAS and controls a bias of the current mirror.

The third PMOS transistor P3 is connected in series to the fifth and sixth NMOS transistors N5 and N6 connected in a diode type to the external voltage VDD, and receives a drain voltage of the second NMOS transistor N3 through a gate terminal thereof. A voltage divided by the fifth and sixth NMOS transistors N5 and N6 is received through a gate terminal of the third NMOS transistor N3.

The first to eighth resistors R1 to R8 are connected in series between the drain terminal of the third PMOS transistor P3 and the ground voltage VSS. Voltages divided by the respective resistors are outputted as the plurality of divided voltages Vtrim<0:7>.

The trimming reference voltage selector 30 may be configured to output the divided voltages Vtrim<0:7> as a trimming reference voltage VREFT in response to a trimming signal TR<0:7>. The trimming reference voltage VREFT may be finally used as a reference voltage or internal voltage inside the semiconductor apparatus.

The trimming reference voltage selector 30 includes a plurality of pass gates. FIG. 1 illustrates a first pass gate PG1 configured to output the divided voltages Vtrim<0:7> as the trimming reference voltage VREFT in response to the trimming signal TR<0:7> and an inverted trimming signal TRB<0:7>.

FIG. 2 is a graph illustrating a temperature characteristic of the voltage trimming circuit 1.

The reference voltage provider 10 provides the reference voltage VREF at a constant level. However, when the temperature changes, the level of the reference voltage VREF changes according to the temperature characteristic of the NMOS transistor N1. Thus, the level change of the reference voltage VREF has an effect on the level of the trimming reference voltage VREF. Therefore, although the reference voltage VREF was trimmed to generate a target-level trimming reference voltage VREFT at a specific temperature, a trimming reference voltage VREFT having a different level from the target-level trimming reference voltage VREFT may be generated when the temperature changes.

Specifically, suppose that the reference voltage VREF was trimmed so that the level of the trimming reference voltage VREFT becomes X, when the temperature is relatively high (temperature A). Then, when the temperature decreases to a temperature B lower than the temperature A, the trimming reference voltage VREFT is not generated at a desired target level Y at the temperature B, but generated at a level Z which is increased according to the diode characteristic.

That is, the conventional voltage trimming circuit can trim the reference voltage level at a specific temperature, but cannot trim the reference voltage level such that the reference voltage has a desired slope depending on the temperature.

SUMMARY

In an embodiment, a voltage trimming circuit of a semiconductor apparatus includes: a first voltage trimming unit configured to trim a first reference voltage having a first characteristic with respect to temperature based on a first trimming signal, and generate a first trimming reference voltage; a second voltage trimming unit configured to trim a second reference voltage having a second characteristic with respect to the temperature based on a second trimming signal, and generate a second trimming reference voltage; and an adjusting unit configured to trim a voltage formed from a potential difference between the first and second trimming reference voltages based on a select signal, and generate a final trimming reference voltage.

In an embodiment, there is provided a voltage trimming method of a semiconductor apparatus which includes: a first voltage trimming unit configured to trim a first reference voltage based on a first trimming signal and generate a first trimming reference voltage; a second voltage trimming unit configured to trim a second reference voltage based on a second trimming signal and generate a second trimming reference voltage; and an adjusting unit configured to trim a voltage formed from a potential difference between the first and second trimming reference voltages based on a select signal and generate a final trimming reference voltage. The voltage trimming method includes the steps of: setting the first and second trimming signals such that the first and second trimming reference voltages having the same level are generated at a first temperature; and setting the select signal such that the final trimming reference voltage is generated with a target level at a second temperature, wherein the first and second reference voltages have different temperature characteristics.

BRIEF DESCRIPTION OF THE DRAWINGS

Features, aspects, and embodiments are described in conjunction with the attached drawings, in which.

DETAILED DESCRIPTION

Hereinafter, a voltage trimming circuit and method of a semiconductor apparatus according to various embodiments will be described below with reference to the accompanying drawings through the embodiments.

Figure 3:
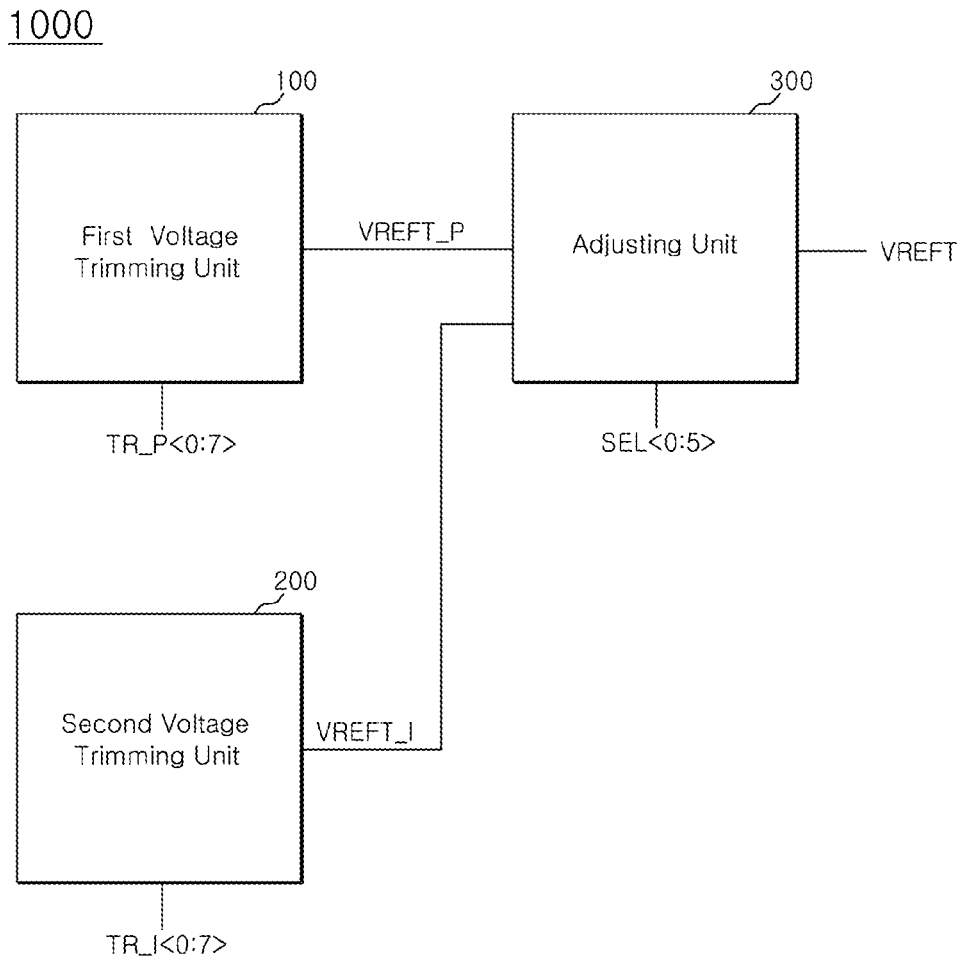
FIG. 3 is a block diagram of a voltage trimming circuit of a semiconductor apparatus according to an embodiment.

FIG. 3 is a block diagram of a voltage trimming circuit 1000 of a semiconductor apparatus according to an embodiment.

The voltage trimming circuit 1000 illustrated in FIG. 3 may include a first voltage trimming unit 100, a second voltage trimming unit 200, and an adjusting unit 300.

The first voltage trimming unit 100 may be configured to trim a first reference voltage having a first characteristic with respect to temperature, based on a first trimming signal TR_P<0:7>. The first voltage trimming unit 100 outputs the trimming result as a first trimming reference voltage VREFT_P.

The second voltage trimming unit 200 may be configured to trim a second reference voltage having a second characteristic with respect to temperature, based on a second trimming signal TR_I<0:7>. The second voltage trimming unit 200 outputs the trimming result as a second trimming reference voltage VREFT_I.

When the first and second reference voltages have the first and second characteristics with respect to temperature, respectively, it means that the slopes of the first and second reference voltages with respect to temperature are different from each other.

The first and second trimming signals TR_P<0:7> and TR_I<0:7> may be applied from a controller (not illustrated) inside the semiconductor apparatus, for example. At this time, the first and second trimming signals TR_P<0:7> and TR_I<0:7> are set in such a manner that the first and second trimming reference voltages VREF_P and VREF_I having the same level are generated at a first temperature.

The adjusting unit 300 may be configured to trim a voltage formed from a potential difference between the first trimming reference voltage VREFT_P and the second trimming reference voltage VREFT_I based on a select signal SEL<0:5>, and generate a final trimming reference voltage VREFT.

The select signal SEL<0:5> may also be applied from the controller (not illustrated) inside the semiconductor apparatus, for example. At this time, the select signal SEL<0:5> may be set in such a manner that the final trimming reference voltage VREFT is generated with a target level at a second temperature different from the first temperature.

Figure 4:
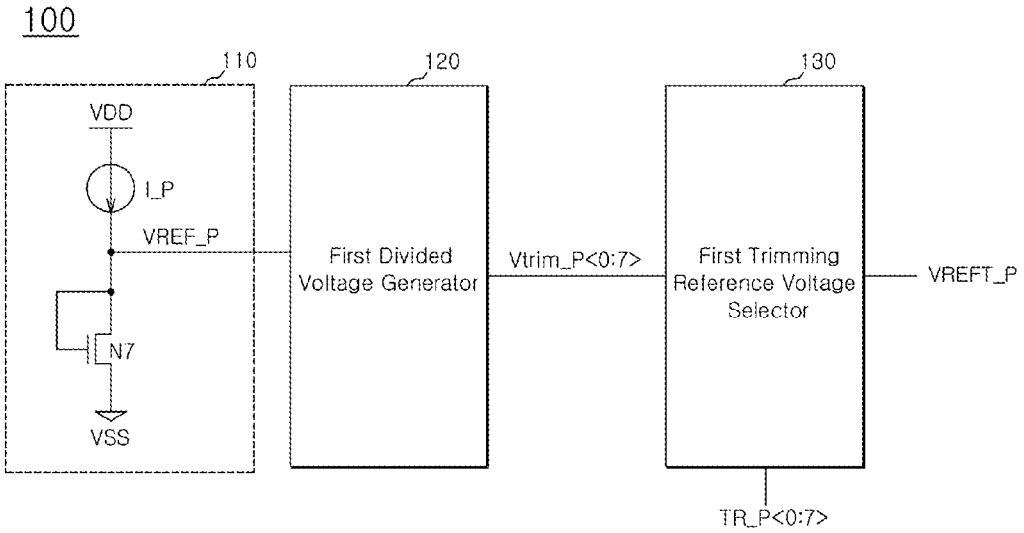
FIG. 4 is a block diagram illustrating an embodiment of a first voltage trimming unit of FIG. 3.

FIG. 4 is a block diagram illustrating an embodiment of the first voltage trimming unit 100.

Figure 1:
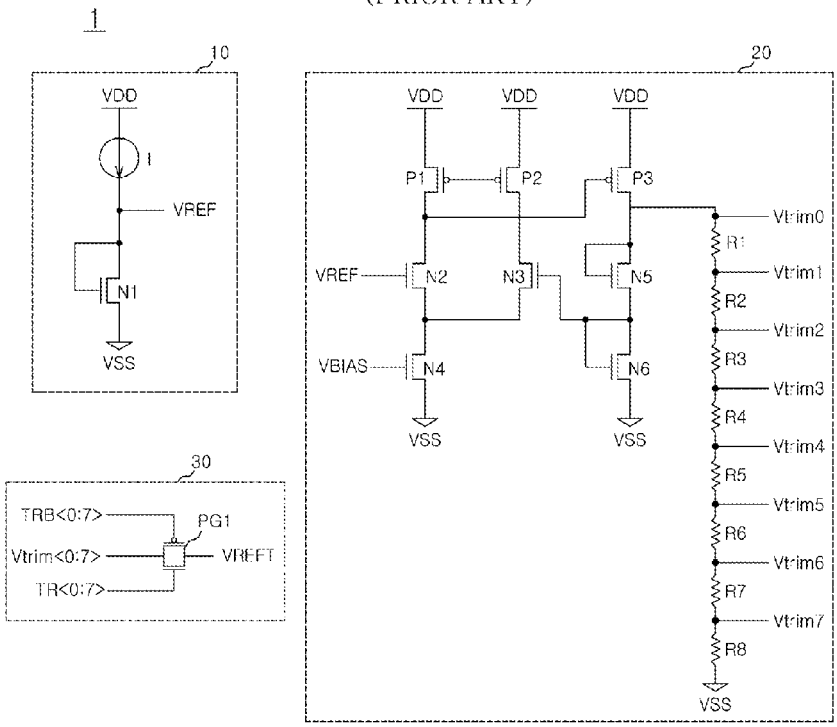
FIG.1 (PRIOR ART)
FIG. 1 is a circuit diagram illustrating a voltage trimming circuit 1 used in a conventional semiconductor apparatus.
Figure 2:
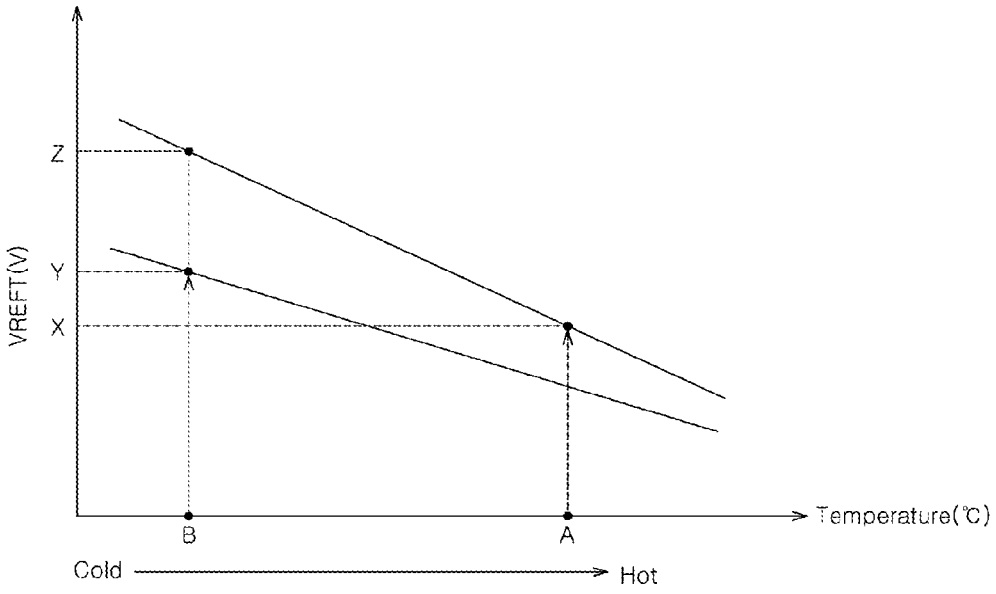
FIG.2 (PRIOR ART)
FIG. 2 is a graph illustrating a temperature characteristic of the voltage trimming circuit of FIG. 1.

The first voltage trimming unit 100 has a similar configuration to the voltage trimming circuit illustrated in FIG. 1. That is, the first voltage trimming unit 100 generates a reference voltage and trims the corresponding reference voltage based on a trimming signal.

The first voltage trimming unit 100 may include a first reference voltage provider 110, a first divided voltage generator 120, and a trimming reference voltage selector 130.

The first reference voltage provider 110 may be configured to generate the first reference voltage VREF_P having the first characteristic with respect to temperature. For example, the first reference voltage provider 110 may include a constant current source I_P and a seventh NMOS transistor N7. The constant current source I_P is connected to the external voltage VDD and configured to supply a constant current. The seventh NMOS transistor N7 having a diode-type structure is connected in series between the constant current source I_P and the ground voltage VSS. A voltage applied to the seventh NMOS transistor N7 by the current supplied by the constant current source I_P is outputted as the first reference voltage VREF_P. Therefore, when the temperature increases according to the diode characteristic, the first reference voltage VREF_P decreases. That is, the first reference voltage VREF_P is inverse proportional to the temperature.

The first divided voltage generator 120 may be configured to generate a plurality of first divided voltages Vtrim<0:7> having various voltage levels based on the first reference voltage VREF_P. The first divided voltage generator 120 has almost the same configuration as the divided voltage generator 120 of FIG. 1. Therefore, the detailed descriptions thereof are omitted herein.

The first trimming reference voltage selector 130 may be configured to output a first divided voltage selected from the plurality of first divided voltages Vtrim<0:7> as the first trimming reference voltage VREFT_P in response to the first trimming signal TR_P<0:7>. As described above, the first trimming signal TR_P<0:7> may be set in such a manner that the first and second trimming reference voltages VREFT_P and VREFT_I are generated with the same level at the first temperature. The first trimming reference voltage selector 130 has almost the same configuration as the trimming reference voltage selector 30 of FIG. 1. Therefore, the detailed descriptions thereof are omitted herein.

Figure 5:
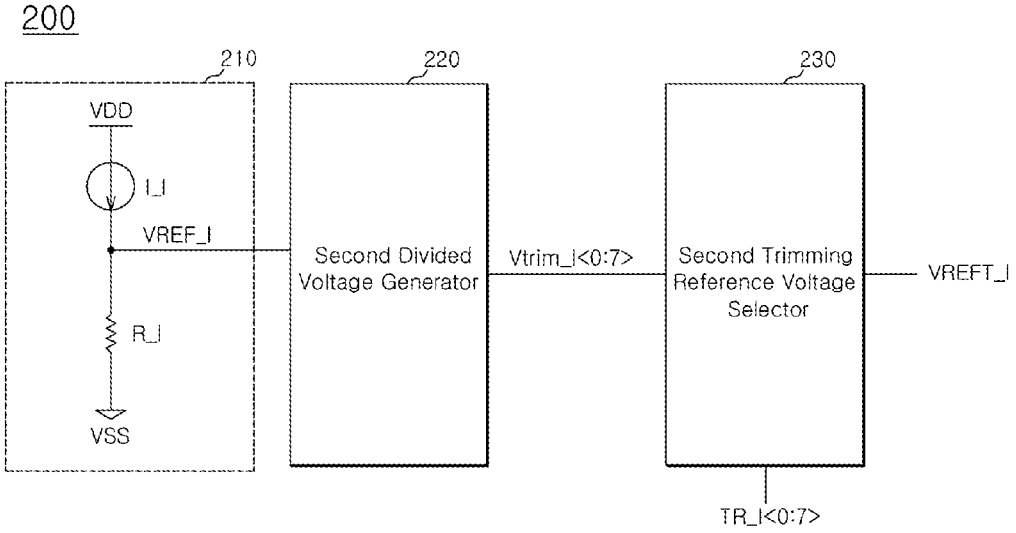
FIG. 5 is a block diagram illustrating an embodiment of a second voltage trimming unit of FIG. 3.

FIG. 5 is a block diagram illustrating an embodiment of the second voltage trimming unit 200.

The second voltage trimming unit 200 also has a similar configuration to the voltage trimming circuit 1 of FIG. 1. That is, the second voltage trimming unit 200 generates a reference voltage and trims the corresponding reference voltage based on a trimming signal.

The second voltage trimming unit 200 may include a second reference voltage provider 210, a second divided voltage generator 220, and a second trimming reference voltage selector 230.

The second reference voltage provider 210 may be configured to generate the second reference voltage VREF_I having the second characteristic with respect to temperature. For example, the second reference voltage provider 210 may include a constant current source I_I and a resistor R_I. The constant current source I_I is connected to the external voltage VDD and configured to supply a constant current. The resistor R_I is connected in series between the constant current source I_I and the ground voltage VSS. A voltage applied to the resistor R_I by the current supplied from the constant current source I_I is outputted as the second reference voltage VREF_I. Therefore, when the temperature increases according to the resistor characteristic, the second reference voltage VREF_I increases. That is, the second reference voltage VREF__1 is proportional to the temperature.

The second divided voltage generator 220 may be configured to generate a plurality of second divided voltages Vtrim_I<0:7> having various voltage levels based on the second reference voltage VREF_I. The second divided voltage generator 220 has almost the same configuration as the divided voltage generator 20 of FIG. 1. Therefore, the detailed descriptions thereof are omitted herein.

The second trimming reference voltage selector 230 may be configured to output a second divided voltage selected from the plurality of second divided voltages Vtrim_I<0:7> as the second trimming reference voltage VREFT_I in response to the second trimming signal TR_I<0:7>. As described above, the second trimming signal TR_I<0:7> may be set in such a manner that the first and second trimming reference voltages VREFT_P and VREFT_I are generated with the same level at the first temperature. The second trimming reference voltage selector 230 has almost the same configuration as the trimming reference voltage selector 30 of FIG. 1. Therefore, the detailed descriptions thereof are omitted herein.

Figure 6:
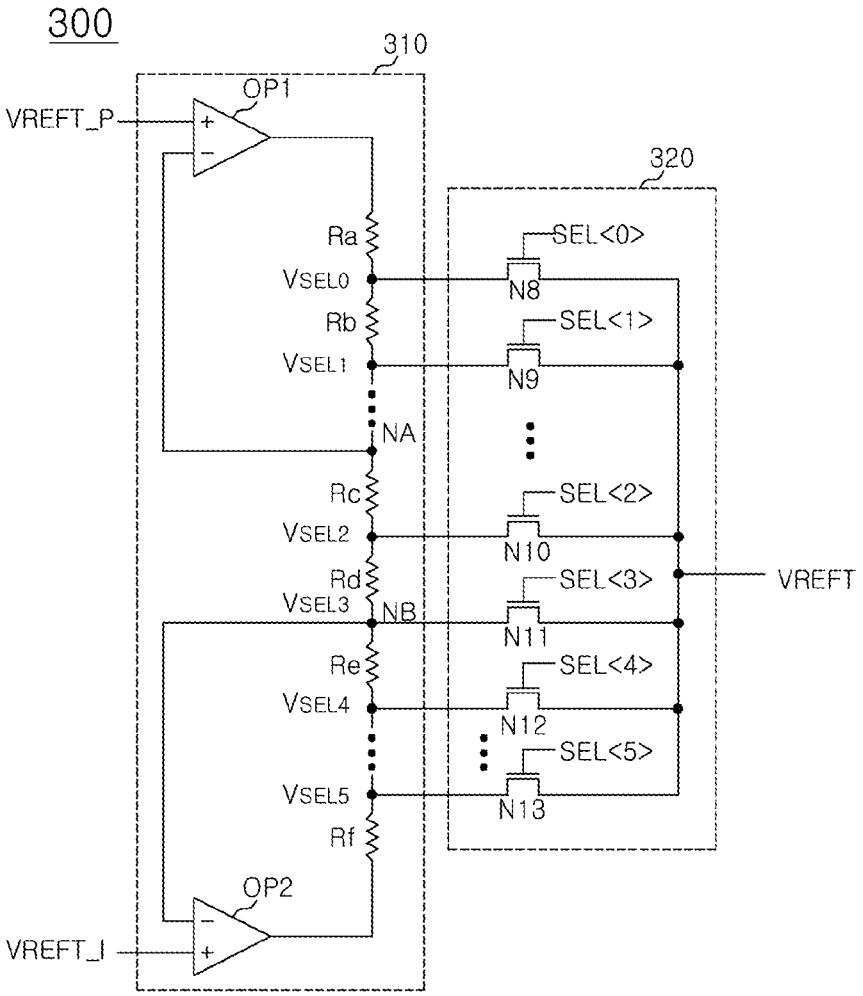
FIG. 6 is a circuit diagram illustrating an embodiment of an adjusting unit of FIG. 3.

FIG. 6 is a circuit diagram illustrating an embodiment of the adjusting unit 300.

The adjusting unit 300 may include a third divided voltage generator 310 and a final trimming reference voltage selector 320.

The third divided voltage generator 310 may be configured to divide a voltage formed from a potential difference between the first and second trimming reference voltages VREFT_P and VREFT_I and generate a plurality of third divided voltages VSEL<0:5>.

Specifically, the third divided voltage generator 310 may include a first comparator OP1, a second comparator OP2, and a resistor section.

The first comparator OP1 may be configured to amplify a difference between the level of the first trimming reference voltage VREFT_P and the voltage level of a first node NA. Specifically, the first comparator OP1 may include an operational amplifier (op-amp).

The second comparator OP2 may be configured to amplify a difference between the level of the second trimming reference voltage VREFT_I and the voltage level of a second node NB. Similarly, the second comparator OP2 may include an op-amp.

The resistor section may include a plurality of resistors Ra to Rf. Specifically, the resistors Ra and Rb between an output node of the first comparator OP1 and the first node NA, the resistors Rc and Rd between the first node NA and the second node NB, and the resistors Re and Rf between the second node NB and an output node of the second comparator OP2 are connected in series. The plurality of resistors Ra to Rf divide a voltage to generate the plurality of third divided voltages VSEL<0:5>.

The final trimming reference voltage selector 320 may be configured to output a third divided voltage selected from the plurality of third divided voltages VSEL<0:5> as the final trimming reference voltage VREFT in response to the select signal SEL<0:5>. As described above, the select signal SEL<0:5> may be set in such a manner that the final trimming reference voltage VREFT is generated with a target level at the second temperature.

Specifically, the final trimming reference voltage selector 320 may include eighth to 13th NMOS transistors N8 to N13. The eighth to 13th NMOS transistors N8 to N13 are configured to output the third divided voltages VSEL<0:5> as the final trimming reference voltage VREFT in response to the respective bits of the select signal SEL<0:5>.

At the first temperature, the adjusting unit 300 receives the first and second trimming reference voltages VREFT_P and VREFT_I having the same level. Due to the characteristic of an ideal comparator, the voltage levels of the first and second nodes NA and NB are equalized to the first and second trimming reference voltages VREFT_P and VREFT_I. Finally, the final trimming reference voltage VREFT at the first temperature is outputted at the same level as the first and second trimming reference voltages VREFT_P and VREFT_I.

At the second temperature, the adjusting unit 300 receives the first and second trimming reference voltages VREFT_P and VREFT_I generated according to the first and second trimming signals TR_P<0:7> and TR_I<0:7>. Since the first and second reference voltages VREF_P and VREF_I have different temperature characteristics, the first and second trimming reference voltages VREFT_P and VREFT_I generated based on the first and second reference voltages VREFT_P and VREF_I have different levels at the second temperature. Therefore, a potential difference is formed between the first and second nodes NA and NB inside the adjusting unit 300, and the verity of third divided voltages VSEL<0:5> are generated. The select signal SEL<0:5> may be set in such a manner that the final trimming reference voltage at the second temperature is outputted at a desired target level among the third divided voltages VSEL<0:5>.

Figure 7:
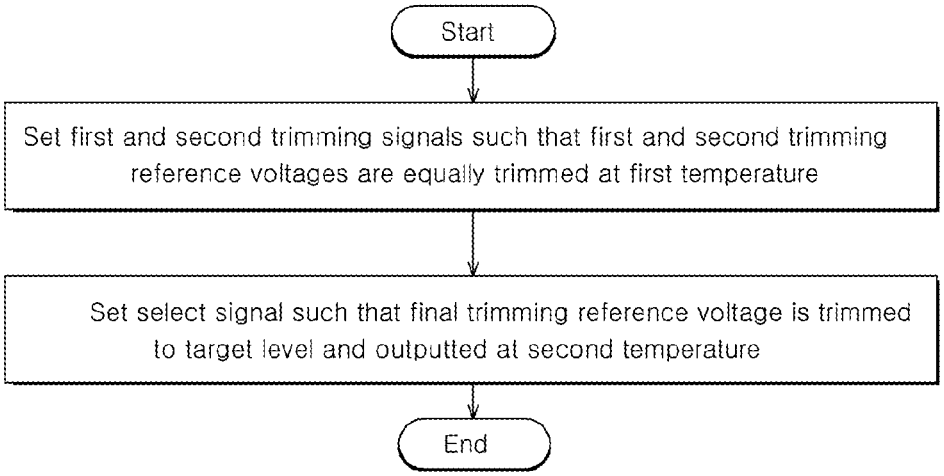
FIG. 7 is a flow chart showing a voltage trimming method of the voltage trimming circuit of FIG. 3.

FIG. 7 is a flow chart showing a voltage trimming method of the voltage trimming circuit of FIG. 3.

At a first step S1, the first and second trimming signals TR_P<0:7> and TR_I<0:7> are in such a manner that the first and second trimming reference voltages VREFT_P and VREFT_I are equally trimmed at the first temperature.

At a second step S2, the select signal SEL<0:5> may be set in such a manner that the final trimming reference voltage VREFT is trimmed to a target level and outputted, at the second temperature.

At this time, the second step S2 is performed based on the first and second trimming signals TR_P<0:7> and TR_I<0:7> set at the first step S1.

Figure 8:
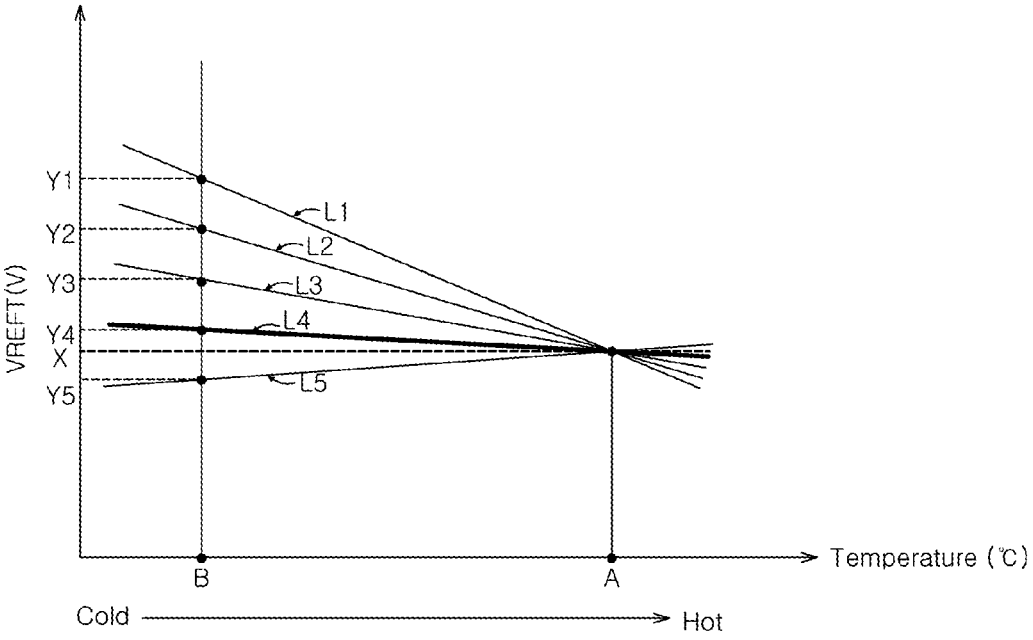
FIG. 8 is a graph illustrating the temperature characteristics of the voltage trimming circuit of FIG. 3.

FIG. 8 is a graph illustrating the temperature characteristics of the voltage trimming circuit 1000 of FIG. 3.

Referring to FIG. 8, the voltage trimming method of FIG. 7 will be described in detail as follows.

At the first temperature, for example, at a relatively-high temperature A, the level of the trimming reference voltage VREFT is trimmed to X. This operation is performed by setting the first and second trimming signals TR_P<0:7> and TR_I<0:7> such that the first and second trimming reference voltages VREFT_P and VREFT_I are equally generated at the first temperature.

Then, the second temperature may be set to a temperature B lower than the temperature A, and the trimming reference voltage VREFT is trimmed to a desired target level Y4 at the temperature B. This operation is performed by setting the select signal SEL<0:5> such that the final trimming reference voltage VREFT is generated with the target level at the second temperature. Therefore, the voltage trimming circuit according to the embodiment generates the trimming reference voltage VREFT with a slope L4 according to the temperature. Furthermore, the slope may be set to various slopes L1 to L5, depending on the desired target level (i.e., Y1-Y5).

The voltage trimming circuit according to the embodiment has a specific slope depending on the temperature. Therefore, the voltage trimming circuit may be used as a circuit to sense the temperature inside a semiconductor apparatus.

While various embodiments have been described above, it will be understood to those skilled in the art that the embodiments described are by way of example only. Accordingly, the semiconductor apparatus described herein should not be limited based on the described embodiments.

What is claimed is:

1. A voltage trimming circuit of a semiconductor apparatus, comprising:

a first voltage trimming unit configured to trim a first reference voltage having a first characteristic with respect to temperature based on a first trimming signal, and generate a first trimming reference voltage;

a second voltage trimming unit configured to trim a second reference voltage having a second characteristic with respect to the temperature based on a second trimming signal, and generate a second trimming reference voltage; and an adjusting unit configured to trim a plurality of third divided voltages formed from a potential difference between the first and second trimming reference voltages, and output a third divided voltage selected from the plurality of third divided voltages as a final trimming reference voltage in response to a select signal, wherein the first and second trimming signals are set in such a manner that the first and second trimming reference voltages having a first level are generated at a first temperature, the select signal is set in such a manner that the final trimming reference voltage is generated with a target level at a second temperature, the adjusting unit is configured to output the final trimming reference voltage having a slope of a line connecting the first level and the target level, and the plurality of third divided voltages comprise a first divided voltage group having at least one third divided voltage dependent on a difference between the first trimming reference voltage and a third divided voltage applied to a first node, a second divided voltage group having at least one third divided voltage dependent on a difference between the second trimming reference voltage and a third divided voltage applied to a second node, and a third divided voltage group having at least one third divided voltage dependent on a potential difference between the first node and the second node.

2. The voltage trimming circuit according to claim 1, wherein the first voltage trimming unit comprises:

a first reference voltage provider configured to generate the first reference voltage having the first characteristic with respect to the temperature from an external voltage;

a first divided voltage generator configured to generate a plurality of first divided voltages having various voltage levels based on the first reference voltage; and a first trimming reference voltage selector configured to output a first divided voltage selected from the plurality of first divided voltages as the first trimming reference voltage in response to the first trimming signal.

3. The voltage trimming circuit according to claim 2, wherein the first reference voltage provider generates the first reference voltage, which is inversely proportional to the temperature, from the external voltage.

4. The voltage trimming circuit according to claim 1, wherein the second voltage trimming unit comprises:

a second reference voltage provider configured to generate the second reference voltage having the second characteristic with respect to the temperature from an external voltage;

a second divided voltage generator configured to generate a plurality of second divided voltages having various voltage levels based on the second reference voltage; and a second trimming reference voltage selector configured to output a second divided voltage selected from the plurality of second divided voltages as the second trimming reference voltage in response to the second trimming signal.

5. The voltage trimming circuit according to claim 4, wherein the second reference voltage provider generates the second reference voltage, which is proportional to the temperature, from the external voltage.

6. The voltage trimming circuit according to claim 1, wherein the adjusting unit comprises:

a first comparator configured to amplify a difference between the first trimming reference voltage level and a voltage level of the first node;

a second comparator configured to amplify a difference between the second trimming reference voltage level and a voltage level of the second node; and a resistor section comprising a plurality of resistors connected between an output node of the first comparator and the first node, between the first node and the second node, and between the second node and an output node of the second comparator, respectively, and configured to generate the plurality of third divided voltages by dividing a voltage through the plurality of resistors.

7. The voltage trimming circuit according to claim 6, wherein the first comparator and the second comparator comprise operational amplifiers.

8. The voltage trimming circuit according to claim 1, wherein the voltage trimming circuit of the semiconductor apparatus is used as a temperature sensing circuit inside a semiconductor apparatus.

9. A voltage trimming method of a semiconductor apparatus which includes:

a first voltage trimming unit configured to trim a first reference voltage based on a first trimming signal and generate a first trimming reference voltage;

a second voltage trimming unit configured to trim a second reference voltage based on a second trimming signal and generate a second trimming reference voltage; and an adjusting unit configured to trim a plurality of third divided voltages formed from a potential difference between the first and second trimming reference voltages, and output a third divided voltage selected from the plurality of third divided voltages as a final trimming reference voltage in response to a select signal, the voltage trimming method comprising the steps of:

setting the first and second trimming signals such that the first and second trimming reference voltages having a first level are generated at a first temperature; and setting the select signal such that the final trimming reference voltage is generated with a target level at a second temperature, wherein the first and second reference voltages have different temperature characteristics, the final trimming reference voltage is configured to have a slope of a line connecting the first level and the target level, and the plurality of third divided voltages comprise a first divided voltage group having at least one third divided voltage dependent on a difference between the first trimming reference voltage and a third divided voltage applied to a first node, a second divided voltage group having at least one third divided voltage dependent on a difference between the second trimming reference voltage and a third divided voltage applied to a second node, and a third divided voltage group having at least one third divided voltage dependent on a potential difference between the first node and the second node.

10. The voltage trimming method according to claim 9, wherein the first reference voltage is inversely proportional to temperature.

11. The voltage trimming method according to claim 9, wherein the second reference voltage is proportional to temperature.

12. The voltage trimming method according to claim 9, wherein the step of setting the select signal is performed based on the first and second trimming signals set at the step of setting the first and second trimming signals.

13. The voltage trimming method according to claim 9, wherein the first temperature is set higher than the second temperature.

* * * * *